United States Patent [19]

Meiller

[11] 4,425,910

[45] Jan. 17, 1984

[54] SEAT HAVING AN ADJUSTABLE BACKREST

[76] Inventor: Hermann Meiller, Pfistermeisterstr. 39, D-8450 Amberg, Fed. Rep. of Germany

[21] Appl. No.: 325,496

[22] Filed: Nov. 27, 1981

[30] Foreign Application Priority Data

Dec. 5, 1980 [DE] Fed. Rep. of Germany ..... 3045809

[51] Int. Cl.[3] ..... A61H 7/00

[52] U.S. Cl. ..... 128/52; 297/284

[58] Field of Search ..... 128/24 R, 33, 50, 51, 128/52, 56, 61, 62, 63, 64, 75, 78; 297/284

[56] References Cited

U.S. PATENT DOCUMENTS 2,427,053 9/1947 Hampton ..... 128/33

3,924,613 12/1975 Beck ..... 128/24 R 4,339,150 7/1982 McNamara et al. ..... 297/284

FOREIGN PATENT DOCUMENTS 2345254 4/1974 Fed. Rep. of Germany ..... 297/284

2541559 3/1977 Fed. Rep. of Germany ..... 297/284

*Primary Examiner*—Richard J. Apley

*Assistant Examiner*—David J. Brown

*Attorney, Agent, or Firm*—Louis E. Marn; Elliot M. Olstein

[57] ABSTRACT

The seat has a backrest with an adjustable vertebral support comprising two separate adjusting elements which act against the rear of the backrest cushion to vary the curvature and spinal support effect thereof, at two different levels in the heightwise direction of the backrest.

10 Claims, 11 Drawing Figures

SEAT HAVING AN ADJUSTABLE BACKREST

BACKGROUND OF THE INVENTION

The present invention relates to a seat having a backrest and an adjustable spinal or vertebral support.

There are various forms of seats with a backrest and an adjustable spinal or vertebral support for supporting in particular the intervertebral discs, comprising an adjusting element which acts against the rear surface of the upholstery cushioning of the seat and which is adjustable in respect of the depth of the backrest. However, such supports are only adjustable in respect of depth, and they are at a fixed position in the heightwise direction of the backrest.

However, the spinal columns of human beings are not all the same. More particularly, human spinal columns can be divided into various types, and for this reason support for the spinal column when a person is in a sitting position should be provided not only at various depths but also at different heights, if the supporting action is to be of optimum efficiency from the medical point of view.

In addition, even with one and the same type of spinal column, it is desirable to be able to alter the load on the intervertebral discs, in order to avoid continuously loading individual discs.

The above-discussed problems are particularly important for the drivers of utility or commercial vehicles, who often have to spend up to eight hours and even more in a sitting position, in each day.

SUMMARY OF THE INVENTION

An object of the present invention is to provide a seat with vertebral or spinal support, wherein the vertebral support is adjustable both in respect of the depth of the backrest and also in the heightwise direction of the backrest.

A further object of the present invention is to provide a seat having a backrest with vertebral support which permits optimum adaptation of the configuration of the backrest to the back of the person sitting in the seat.

Still another object of the present invention is to provide a seat with a backrest vertebral support arrangement therein, which is adapted to enhance the comfort of a person sitting in the seat.

A further object of the invention is to provide a vertebral support in the backrest of a seat, more particularly for a commercial vehicle, which permits the nature of the vertebral support to be readily adjusted by the person using the seat.

These and other objects are attained in a seat comprising a backrest having a vertebral or spinal support means therein, wherein first and second separate adjusting elements which are adjustable in respect of the depth of the backrest are disposed one above the other in the heightwise direction of the backrest.

With such a vertebral support means, in accordance with the principles of this invention, the curvature of the surface of the backrest can be altered both in respect of depth and also in respect of height, by one or both of the adjusting elements being adjusted in respect of depth, that is to say, in a direction which is substantially perpendicular to the general plane of the backrest. If for example the lower adjusting element is displaced rearwardly and the upper adjusting element is displaced forwardly, then the curvature of the surface of the backrest moves upwardly of the backrest.

In this way, the contour of the backrest can be readily adapted to the individual curvature of the spinal column of a person requiring to use the seat, thereby substantially eliminating lumbar pains.

Desirably, the adjusting elements are spring plate members which are capable of assuming an outwardly curved configuration, the spring plate members being fixedly clamped at one end and being mounted movably at the opposite end. With this arrangement, the movable end of the spring plate member can be displaced towards or away from the fixed end, thereby to alter the degree of curvature of the plate member.

In this arrangement also, from the point of view of general design, it is advantageous for the spring plate members to be adapted to be compressible to produce a curvature in respect of the depth of the backrest, not in the heightwise direction of the backrest but in a direction transversely with respect thereto, that is to say, the fixed end of the spring plate member and the movably mounted end of the spring plate member are disposed on a horizontal line and not on a substantially vertical line. The spring plate member therefore extends across the backrest, and not in the heightwise direction thereof.

It may also be advantageous for the adjusting elements to engage a common curvable support plate which is provided at the rear of the upholstery of the backrest.

Preferably, the two movable ends of the spring plate members are secured to a common connecting member which is mounted displaceably to the backrest support structure by way of two pin-and-slot type guide means which are disposed at a spacing from each other in the heightwise direction of the backrest, wherein an actuating member which is movable transversely with respect to the heightwise direction of the backrest acts on the connecting member asymmetrically between the two pin-and-slot type guide means, the general arrangement being such that, upon movement of the actuating member against the spring force of the spring plate members, the spring plate member which is closest to the point at which the actuating member acts on the connecting member is compressed first, performing a pivotal movement about the pin of the pin-and-slot type guide means which is at a greater spacing from the point of action of the actuating member, while when the pin bears against the end of the slot of the guide means which is closer to said point of action, the other spring plate member is compressed, performing a pivotal movement about the pin which is in a position of abutment against the end of the slot, as referred to above. Therefore, when the actuating member is moved in one direction, one spring plate member is first compressed until it has taken up a position of full curvature and thereafter, upon further movement of the actuating member in the specified direction, the other spring plate member is compressed to a position of full curvature. If the actuating member is retracted, the modes of operation are correspondingly reversed. In this embodiment therefore, only a single actuating member is required for adjustment both in respect of height and in respect of depth, in relation to the backrest.

In order to provide an actuating arrangement which occupies the minimum possible amount of space, both in a direction transversely with respect to the backrest and also in the heightwise direction of the backrest, another aspect of the invention may provide an intermediate member between the actuating member and the connecting member. The intermediate member is connected to the connecting member rotatably about an axis which is normal to the backrest and which forms the point at which the actuating member acts on the connecting member; the intermediate member is guided on the backrest support structure, for example by a guide means of pin-and-slot type, in such a way that, when the actuating member is moved in opposition to the spring force of the spring plate members, the intermediate member is first guided linearly transversely with respect to the heightwise direction of the backrest, and, after the pin comes to bear against the end of the slot of the pin-and-slot guide means which is closer to the point of action, the intermediate member is moved in the heightwise direction of the backrest, to perform a pivotal movement. By virtue of the provision of the intermediate member, the actuating member can engage a point which is displaced with respect to the point of action on the connecting member and which can be selected in accordance with the particular considerations in respect of three-dimensional configuration, and the pivotal movement of the intermediate member in a second phase of movement permits the actuating means to be of more compact design in a direction transverse with respect to the heightwise direction of the backrest.

The actuating member can be arranged to be displaced by means of a manual rotary knob and a spindle assembly.

Alternatively, the actuating member can also be in the form of a double-armed lever, of which one end acts on the connecting member while the other end is connected to an eccentric cam or disc member connected to an electric motor, to produce a reciprocating pivotal movement. With this construction, not only is operator comfort substantially enhanced but the construction also permits a cyclic displacement in the curvature of the vertebral support, thereby producing a certain massage effect for the spinal column.

Advantageously, the electric motor is connected to a circuit which automatically switches off the electric motor, at a preset position, after the eccentric disc member has rotated through a number of revolutions, so that, if the user of the seat suffers from fatigue, the user only has to operate a knob or button once in order thereby to enjoy massage of the spinal column, after which the vertebral support is reset to the same position as had been set previously.

In a further development of the above-mentioned circuit, the electric motor is automatically switched on at predetermined intervals of time, thereby enhancing not only the operator comfort of the seat but also the attentiveness of the driver. This action of keeping the driver awake, by virtue of the vertebral support switching on automatically to massage the spinal column, permits a substantial improvement in regard to driving safety.

Further features, details and advantages of the present invention will be set forth in the following description of a preferred embodiment, with reference to the accompanying drawings.

DESCRIPTION OF THE PREFERRED EMBODIMENTS

Figure 1:
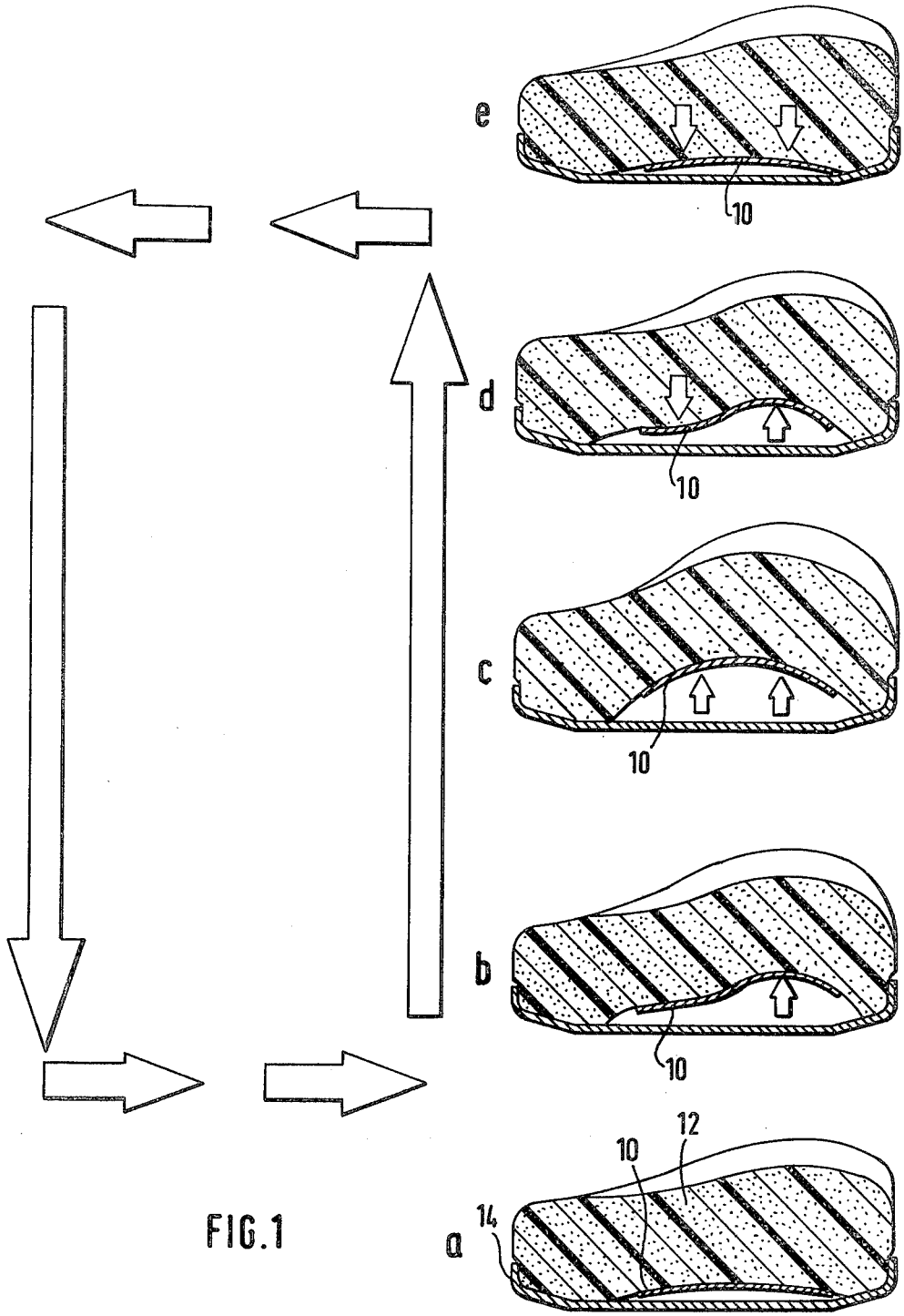
FIG. 1 shows diagrammatic sectional views of a backrest having a vertebral or spinal support in accordance with the invention, in order to illustrate the successive positions of adjustment of the vertebral support.

Reference is now made to the drawings and more particular FIG. 1 which shows a backrest which is illustrated in a horizontal position for the sake of convenience, and also a diagram illustrating the succession of movements of the vertebral or spinal support in accordance with the invention. The actuating arrangement is not illustrated in FIG. 1.

In position a in FIG. 1, a support plate 10 which acts on the rear of the backrest cushion 12 is disposed in a substantially flat position in which the plate 10 and therefore also the backrest cushion are not curved or are only slightly curved. In position b which is the next successive position in time, the support plate 10 has been moved into a curved configuration in its lower portion, close to the pelvis of the person in the seat. The point of increased curvature is indicated by the arrow. In the next position c, the upper portion of the support plate 10 and correspondingly also the backrest cushion 12 are additionally curved outwardly. In position d, the curvature of the upper portion of the support plate 10 has been reduced, while in the following position e, the curvature in the lower portion of the support plate 10 has also been substantially reduced, thereby returning the seat backrest to a position corresponding to original position a. Reference numeral 14 in FIG. 1 denotes the backrest support structure or carrier.

Figure 3:
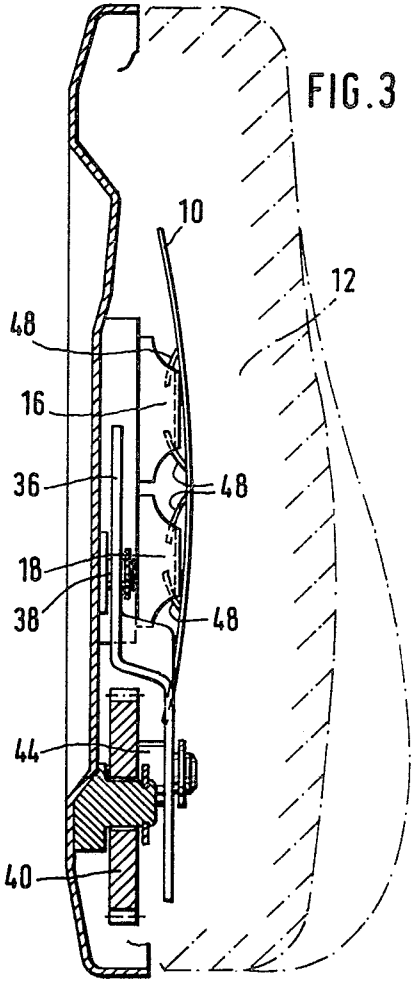
FIG. 3 shows a diagrammatic side view of the FIG. 2 construction, in the first position.
Figure 2:
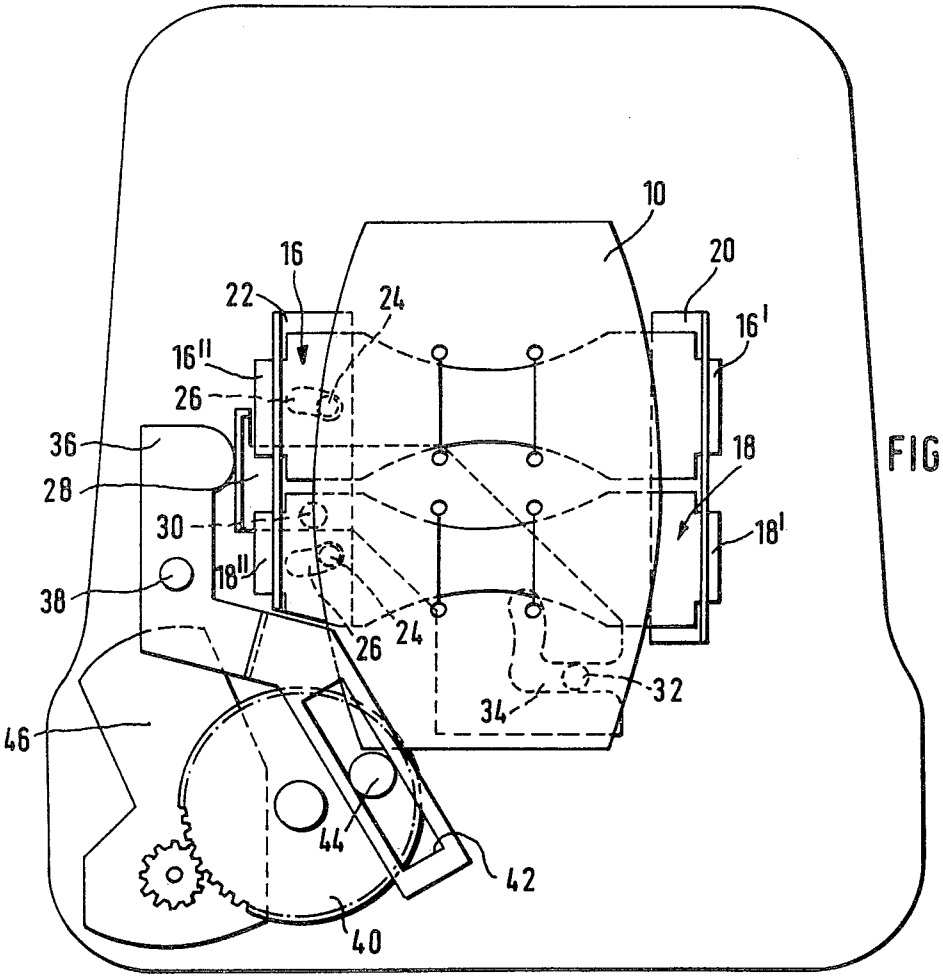
FIG. 2 is a diagrammatic plan view of an embodiment of the invention in a first position.
Figure 5:
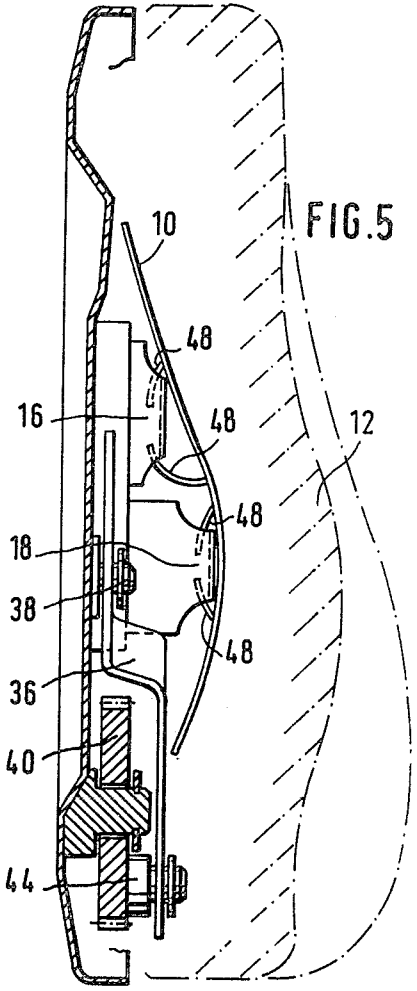
FIG. 5 shows a side view of the FIG. 2 construction in a second position.

Reference will now be made to FIGS. 2 and 3 in order to describe the structure of one embodiment of the invention, in greater detail. As will be seen from these Figures, two adjusting elements 16 and 18 are arranged one above the other in the backrest. As shown, the adjusting elements 16 and 18 are elongate spring plate members having a constriction of reduced-width portion in their centre. When the spring plate members which extend substantially horizontally, that is to say, transversely with respect to the heightwise direction of the backrest, are compressed, in a manner to be described hereinafter, the constriction portion referred to above will facilitate movement of the spring plate members into a curved configuration. First ends 16' and 18' of the elements 16 and 18 are mounted in a stationary holder 20 in which for example the ends of the spring plate members are passed through slots in the holder 20, while the ends 16″ and 18″ of the elements 16 and 18, which are remote from the fixedly held ends 16′ and 18′, are secured to a movably disposed connecting member 22, for example by means of the same kind of structure as that connecting the ends 16′ and 18′ to the holder 20. It is pointed out at this stage that the arrangement has only a single connecting member 22 which is common to both ends 16″ and 18″ of the elements 16 and 18.

Figure 6:
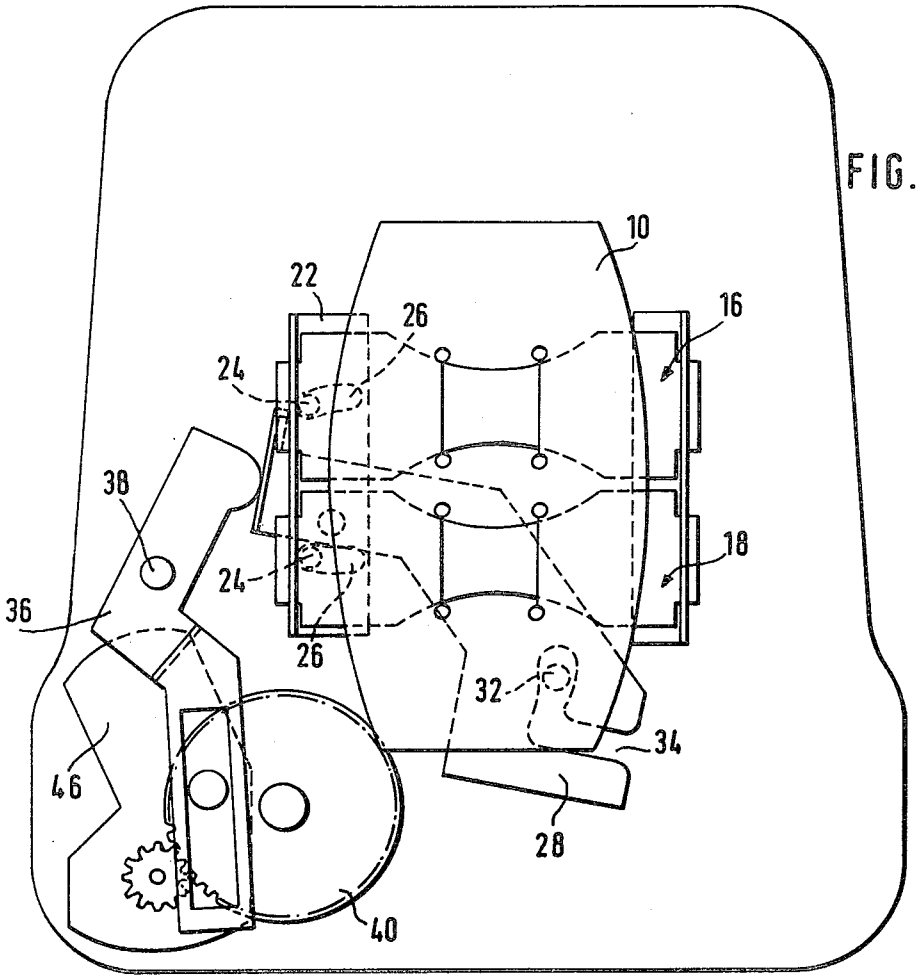
FIG. 6 shows a plan view of this construction in a third position.
Figure 10:
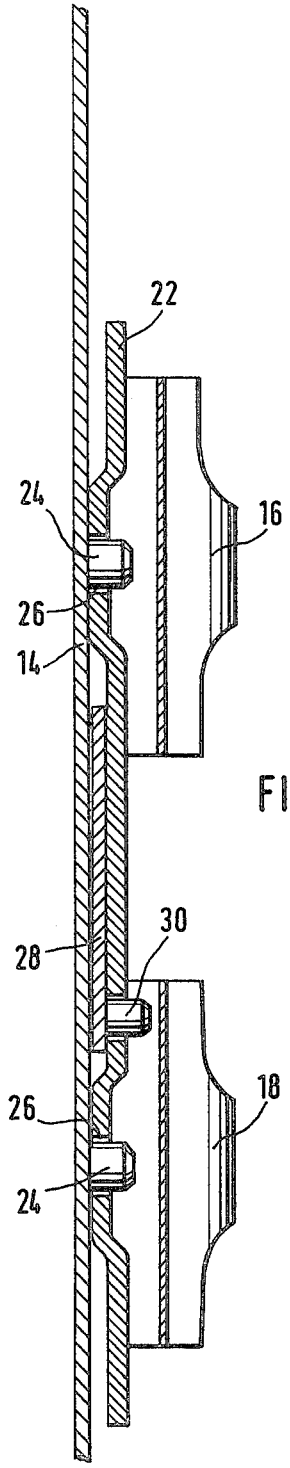
FIG. 10 shows a view in section in the heightwise direction of the backrest, in respect of both embodiments.

Reference should now also be made to FIG. 10, as well as FIGS. 2 and 3, from which it will be seen that the connecting member 22 which extends substantially in the heightwise direction of the backrest is mounted movably on the backrest support structure or carrier 14 by way of two guide means of pin-and-slot type. Each of the guide means comprises a pin 24 which is fixedly mounted to the backrest support structure 14, and an associated slot 26. The arrangement and the configuration of the guide means 24, 26 can be seen in detail from FIG. 2. The arrangement and the configuration of the slots 26 are so selected that, in the position shown in FIG. 2, the connecting member 22 can be pivoted about the upper pin 24 until the lower pin 24 comes to bear against the left-hand end of the slot 26, this being the condition shown in FIG. 4. Then, the connecting member 22 can be pivoted about the lower pin 24 until the upper pin 24 comes to bear against the left-hand end of the slot 26, once again as shown in FIG. 6.

The connecting member 22 and the holder 20 are for example of L-shaped configuration, as can also be seen from the drawing.

The illustrated arrangement also has an intermediate member 28 which is in the form of a double-armed lever and which is arranged in the manner shown in detail in FIGS. 2 and 10. Thus, the intermediate member 28 is connected to the connecting member 22 pivotally about an axis such as a pin as indicated at 30, and is also guided on the backrest support structure by means of a pin 32 and a cooperating slot 34. This pin-and-slot guide means can be seen in detail for example from FIG. 2. The arrangement of the guide means is such that, when the intermediate member 28 is subjected to a load transversely with respect to the heightwise direction of the backrest, that is to say, from left to right in FIG. 2, the intermediate member 28 is first guided transversely with respect to the heightwise direction of the backrest, with a linear movement, until it reaches the position shown in FIG. 4, whereupon, upon being subjected to a further force towards the right in FIG. 4, the intermediate member 28 pivots about the pin 30, without continuing to move in a transverse direction with respect to the height of the backrest, until the intermediate member moves into the position shown in FIG. 6.

An actuating member 36 which is in the form of a double-armed lever is mounted to the backrest support structure pivotally about an axis such as a pin 38. A first end of the actuating member 36 engages against the intermediate member 28, while the second end is connected to an eccentric disc 40 by means of a projection or pin 44 which projects from the disc 40 and which engages into a slot 42 in the associated arm of the actuating member 36, thereby to cause a reciprocating pivotal movement of the actuating member 36 when the disc 40 rotates. Reference numeral 46 denotes a diagrammatically illustrated electric motor for driving the disc 40.

As can be clearly seen from FIGS. 2 and 3, the support plate 10 which bears against the rear of the backrest cushion 12 and which is adapted to be curved outwardly is fixed to the elements 16 and 18 in the region of the constriction portions thereof, by means of bar or clip portions 48 which are stamped or punched out of the support plate 10.

Figure 4:
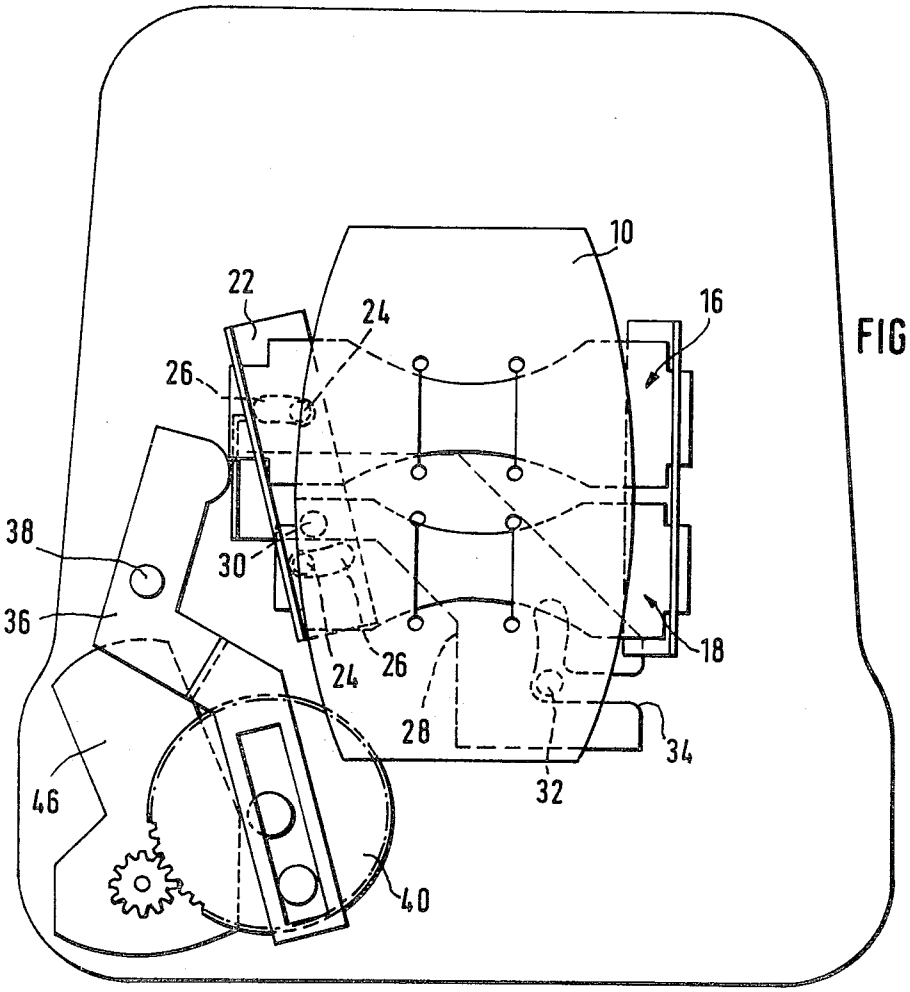
FIG. 4 shows a plan view of this construction in a second position.
Figure 7:
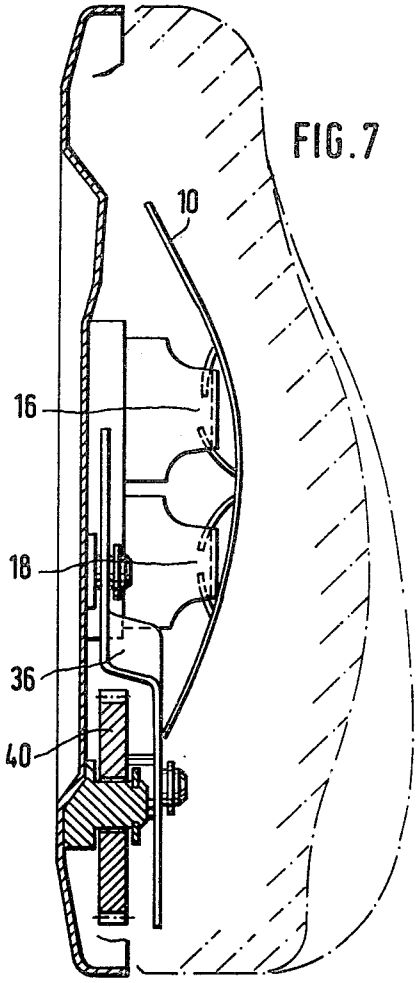
FIG. 7 shows a side view of this construction in the third position.

The mode of operation of the construction shown in FIGS. 2 through 7 will now be described in greater detail:

The initial position is that shown in FIGS. 2 and 3, which also corresponds to position a in FIG. 1. The spring plate members which serve as the adjusting elements 16 and 18 are in a substantially unstressed condition when they are in their position of maximum length, so that the support plate 10 lies substantially flat. If now the disc 40 is rotated in the clockwise direction as viewed in FIG. 2 for example, the actuating member 36 is pivoted and the intermediate member 28 is moved from right to left, transversely with respect to the heightwise direction of the backrest. When this movement takes place, the intermediate member 28 moves with a linear motion, by virtue of the configuration of the guide means formed by the pin 32 and the slot 34. As the pin 30 connecting the intermediate member 28 and the connecting member 22, which forms the point at which the intermediate member acts on the connecting member, is disposed closer to the element 18 than the element 16, the element 18 is compressed by virtue of the lever effect, that is to say, the distance between the ends 18′ and 18″ of the element 18 is reduced, while the length of the element 16 remains unaltered. When this movement occurs, the connecting member 22 pivots about the upper pin 24 until the lower pin 24 comes to a position of abutting against the end of the associated slot 26. This is the position which is shown in FIG. 4, in which the lower element 18 has the maximum effect so that the support plate 10 is curved outwardly in its lower portion, as can be seen from FIG. 5. This is the position corresponding to position b in FIG. 1.

Upon further pivotal movement of the actuating member 36 towards the right, the connecting member 22 now necessarily pivots in a clockwise direction about the lower pin 24 so that the upper element 16 is also compressed, that is to say, the distance between the ends 16′ and 16″ thereof is reduced, whereby the upper element 16 is outwardly curved. When this happens, the upper pin 24 comes to bear against the left end of the associated slot 26 and the actuating member 28 performs a pivotal movement, which is defined by the configuration of the slot 24, as can be clearly seen from a comparison between the limit position shown in FIG. 6 and the position shown in FIG. 4. Both elements 16 and 18 have now been compressed and are curved outwardly, so that the support plate 10 is curved outwardly both in its lower portion and in its upper portion, as can be seen from FIG. 7. This corresponds to position c in FIG. 1.

Upon further rotary movement of the disc 40 in the clockwise direction, the actuating member 36 begins to pivot back again, so that the above-described movements are performed in the reverse direction. The elements 16 and 18 and the support plate 10 move back into their starting position (see FIGS. 2 and 3, positions e and a in FIG. 1), by way of the position corresponding to position d in FIG. 1. The cycle of operation is now concluded.

Figure 8:
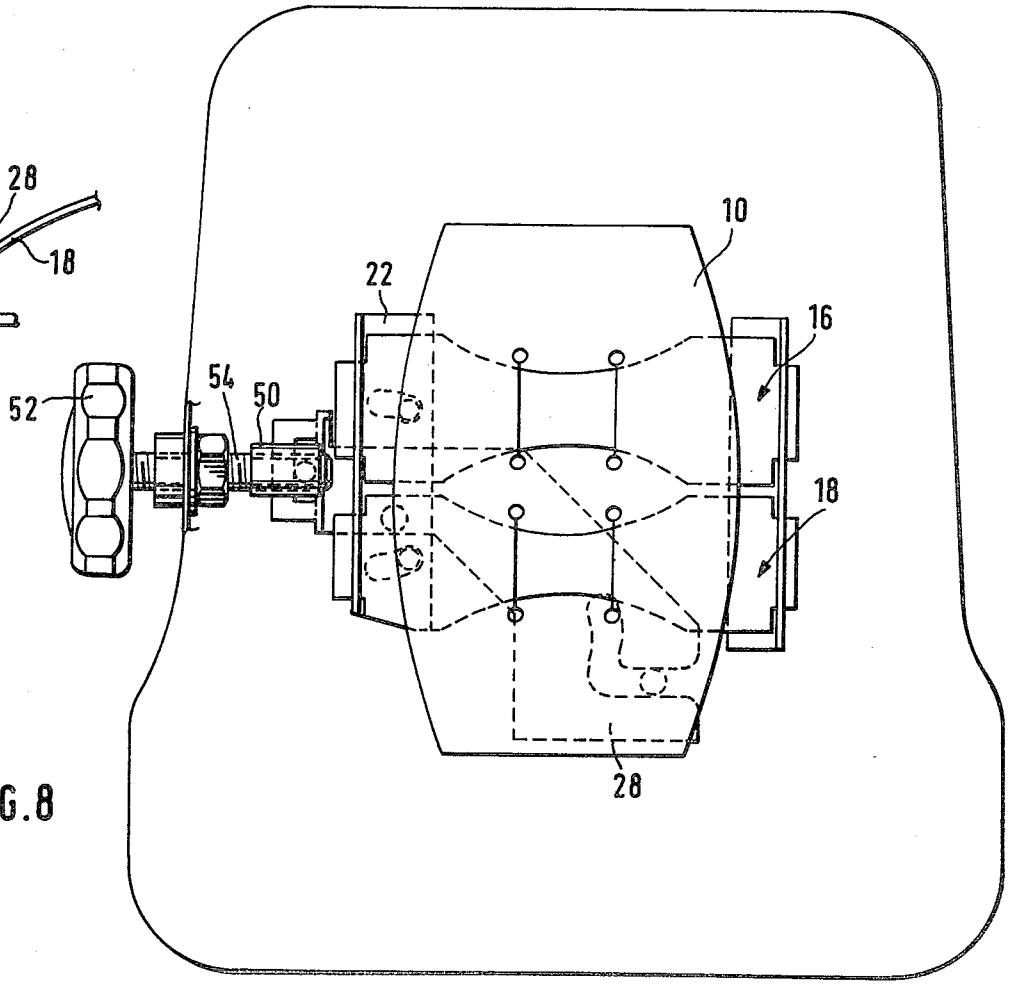
FIG. 8 shows a diagrammatic plan view of a second embodiment.
Figure 9:
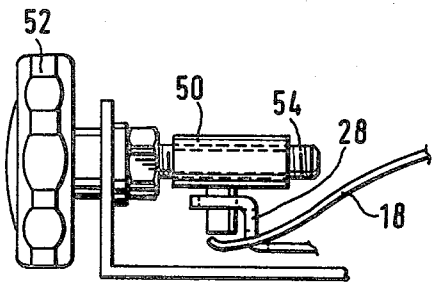
FIG. 9 shows a portion of the second embodiment shown in FIG. 8.

Reference will now be made to FIGS. 8 and 9 showing a second embodiment which differs from the preceding embodiment in that the movement of the intermediate member is produced manually. The actuating member is now in the form of a nut 50, or a female-thread member, which is carried on a spindle 54 which is adapted to be rotated by a hand rotary knob 52. The member 50 is non-rotatably mounted to the intermediate member 28, to produce movement thereof. In other respects, this embodiment is substantially the same as the above-described embodiment. When the actuating member 50 is turned in, the arrangement passes through positions a through c in FIG. 1, while when the actuating member 50 is turned out, the arrangement passes through positions c through e. The rotary movement may be stopped at any desired position so that the arrangement can take up any intermediate positions between those shown at a through e in FIG. 1.

The present invention also includes a construction in which the connecting member 22 and the intermediate member 28 are omitted and the elements 16 and 18 can be compressed and released independently of each other, for example by means of two spindle assemblies as shown in FIG. 9. In that case for example, a curved configuration may be produced only in the upper portion of the backrest, so that the lower portion of the backrest does not have any curvature. Conversely however, the curvature may be produced only in the lower portion, but not in the upper portion. Therefore, actuating the elements 16 and 18 independently of each other has the advantage that in fact the arrangement can take up all possible intermediate positions, on the basis of any desired combination of possibilities.

Figure 11:
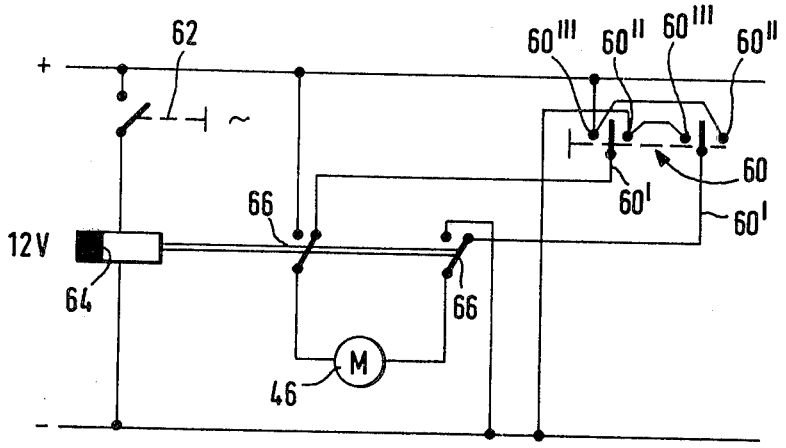
FIG. 11 shows a circuit for controlling an electric motor which is used in connection with the first embodiment.

Reference will now be made to FIG. 11 showing a circuit for operating the electric motor 46 in the construction shown in FIGS. 2 through 7. In FIG. 11, reference numeral 60 denotes a switch for switching the d.c. electric motor 46 on and off, and for reversing the direction of rotation thereof, reference 62 denotes a guick-action switch, while reference 64 denotes a self-holding relay which releases after a certain period of time, for example 90 seconds. If the switch 60 is actuated for example towards the right in FIG. 11, so that the working contacts 60', 60' thereof come into contact with the stationary contacts 60'' and 60'', then the electric motor rotates in one direction, while it rotates in the opposite direction when the contacts 60' and 60' are actuated towards the left so as to come into contact with the stationary contacts 60''. The switch 60 is provided primarily for adjusting the vertebral or spinal support.

By actuating the switch 62 for a short period, the double-pole switch 66 is switched over by way of the relay 64, so that the switch 60 is automatically taken out of operation and the electric motor begins to run in one direction until the relay 64 is released after a predetermined period of time, and the double-pole switch 66 falls back into the position shown in FIG. 11. In the meantime, the eccentric disc 40 which is driven by the electric motor 46 has rotated through a number of revolutions, so as to perform a cyclic massage of the spinal column, which is beneficial to the person sitting in the seat.

A timing circuit which is switched on by pressing a pushbutton and which automatically switches off or which even switches on at given and possibly presettable intervals of time, for a given interval of time which can also be selected as desired, can also be provided in known forms of vertebral support arrangements, an electric motor which is controlled by the timing circuit merely having to be incorporated into the arrangement, for adjustment thereof. More particularly, the timing circuit shown in FIG. 11 can also be employed in such a case.

Various modifications and alterations may be made in the above-described structures without thereby departing from the spirit and scope of the present invention.

What is claimed is:

1. A seat having a backrest including a backrest cushion positioned on a backrest structure which comprises an adjustable vertebral support positioned within said backrest and comprised of first and second adjusting elements disposed one above the other in a heightwise direction adapted to act on a rear portion of said backrest cushion, said adjusting elements being comprised of spring plate members having first and second ends, said first ends of said spring plate members being fixedly held, said second end members being movably mounted to permit curving of said spring plate members, said second end members being mounted to a common connecting member displaceably mounted to said backrest structure of said backrest by spaced apart pin-and-slot type guide elements, said spaced apart pin-and-slot type guide elements being disposed from one another in said heightwise direction; and an actuating member for coöperating with said connecting member and disposed between said guide elements transversely movably with respect to said heightwise direction of said backrest whereby movement of said actuating member against spring force of said spring plate member causes said spring plate member closest to a point at which said actuating member cooperated with said connecting member to pivot about said pin of said guide element furthest from said point whereat said pin of said guide element closest to said point is caused to abut said slot of said guide element closest to said point whereby said other spring plate member is caused to be compressed to pivotally move about said pin of said guide member closest to said point.

2. The seat as set forth in claim 1 wherein said adjusting elements are adapted to be compressible in a direction transverse with respect to said heightwise direction of said backrest thereby to produce an outward curvature in respect of depth of said backrest.

3. The seat as set forth in claim 1 wherein said adjusting elements operatively engage a common curvable support plate disposed on said rear portion of said backrest cushion.

4. The seat as set forth in claim 1 and further including an intermediate member disposed between said actuating member and said connecting member, said intermediate member being pivotally connected to said connecting member about a pivot means normal to said backrest and forming a point of engagement of said actuating member on said connecting member, said intermediate member being guided on said backrest support structure when said actuating member is moved in an opposite direction to said spring force of said spring plate members linearly transverse with respect to said heightwise direction of said backrest and, after said pin of said guide means closest to said point of engagement moves into a position of abutment against its associated slot, said intermediate member is caused to move in a heightwise direction of said backrest.

5. The seat as set forth in claim 1 wherein said actuating member is in the form of a double-armed lever having a first end adapted to act on said connecting member and a second end connected to an eccentric drive member connected to an electric motor thereby to produce a reciprocating pivotal movement of said actuating member.

6. The seat as set forth in claim 5 wherein said electric motor is connected to a circuit adapted to switch the electric motor off automatically after said eccentric drive means has performed a number of revolutions.

7. The seat as set forth in claim 6 wherein said circuit is adapted to switch said electric motor off automatically at a preset location.

8. The seat as set forth in claim 6 or 7 wherein said circuit switches said electric motor on automatically at predetermined intervals of time.

9. The seat as set forth in claim 4 wherein said intermediate member is guided on said backrest structure by a pin-and-slot guide element.

10. The seat as set forth in claim 1 and further comprising an actuating assembly adapted sequentially to produce variations in curvature of each of said spring plate members.

* * * * *